United States Patent [19]

Bania

[11] Patent Number: 4,738,822

[45] Date of Patent: Apr. 19, 1988

[54] TITANIUM ALLOY FOR ELEVATED TEMPERATURE APPLICATIONS

[75] Inventor: Paul J. Bania, Boulder City, Nev.

[73] Assignee: Titanium Metals Corporation of America (TIMET), Pittsburgh, Pa.

[21] Appl. No.: 925,174

[22] Filed: Oct. 31, 1986

[51] Int. Cl.[4] ..... C22C 14/00

[52] U.S. Cl. ..... 420/419; 148/407

[58] Field of Search ..... 420/419; 148/407, 421

[56] References Cited

U.S. PATENT DOCUMENTS 3,619,184 11/1971 Bomberger, Jr. et al. ..... 420/419

4,087,292 5/1978 Neal et al. ..... 148/407

FOREIGN PATENT DOCUMENTS 107419 5/1984 European Pat. Off. ..... 420/419

*Primary Examiner*—L. Dewayne Rutledge

*Assistant Examiner*—Robert L. McDowell

*Attorney, Agent, or Firm*—Finnegan, Henderson, Farabow, Garrett & Dunner

[57] ABSTRACT

A titanium-base alloy having good elevated temperature properties, particularly creep resistance in the 950° to 1100° F. temperature range. The alloy consists essentially of, in weight percent, aluminum 5.5 to 6.5, tin 2.00 to 4.00, preferably 2.25 to 3.25, zirconium 3.5 to 4.5, molybdenum 0.3 to 0.5, silicon above 0.35 to 0.55, iron less than 0.03, oxygen up to 0.14, preferably up to 0.09 and balance titanium.

7 Claims, 5 Drawing Sheets

TITANIUM ALLOY FOR ELEVATED TEMPERATURE APPLICATIONS

BACKGROUND OF THE INVENTION

In various commercial applications, such as in the manufacture of gas turbine engines, titanium-based alloys are used in the production of components therefor, such as fan discs and blades, compressor discs and blades, vanes, cases, impellers and the sheet-metal structure in the afterburner sections of these engines. In many of these applications, the gas turbine engine components of the titanium-based alloys are subjected to operating temperatures on the order of 950° F. to 1000° F. It is necessary that these components resist deformation (creep) at these high operating temperatures for prolonged periods of time and under conditions of stress. Consequently, it is significant that these alloys exhibit high resistance to creep at elevated temperatures and maintain this property for prolonged periods under these conditions of stress at elevated temperature.

Conventionally a titanium-based alloy having nominally, in weight percent, 6% aluminum, 2% tin, 4% zirconium, 2% molybdenum, 0.1% silicon, 0.08% iron, 0.11% oxygen and balance titanium (Ti6242-Si) is used in these applications, such as components for gas turbine engines, where high-temperature creep properties are significant. As turbine engine designers achieve improved engine performance, operating temperatures are correspondingly increased. Consequently, there is a current need for titanium-base alloys that will resist deformation at even higher operating temperatures, for example up to 1100° F. and/or at higher stress levels than are presently achievable with conventional alloys, such as the alloy Ti-6242-Si. While it is important that the alloy retain resistance to deformation at elevated temperature for prolonged periods during use, it may also be important that sufficient room temperature ductility of the alloy be retained after sustained creep exposure. This is termed post-creep stability. Likewise, other mechanical properties, such as room and elevated temperature tensile strength, must be achieved at levels satisfactory for intended commercial applications.

OBJECTS OF THE INVENTION

It is accordingly a primary object of the present invention to provide a titanium-base alloy that achieves an excellent combination of creep resistance, post-creep stability and yield strength.

It is an additional object of the invention to provide an alloy having the aforementioned combination of properties which is of a metallurgical composition that is practical to melt and process into useable parts and embodies relatively low cost alloying constituents.

SUMMARY OF THE INVENTION

Figure 1:
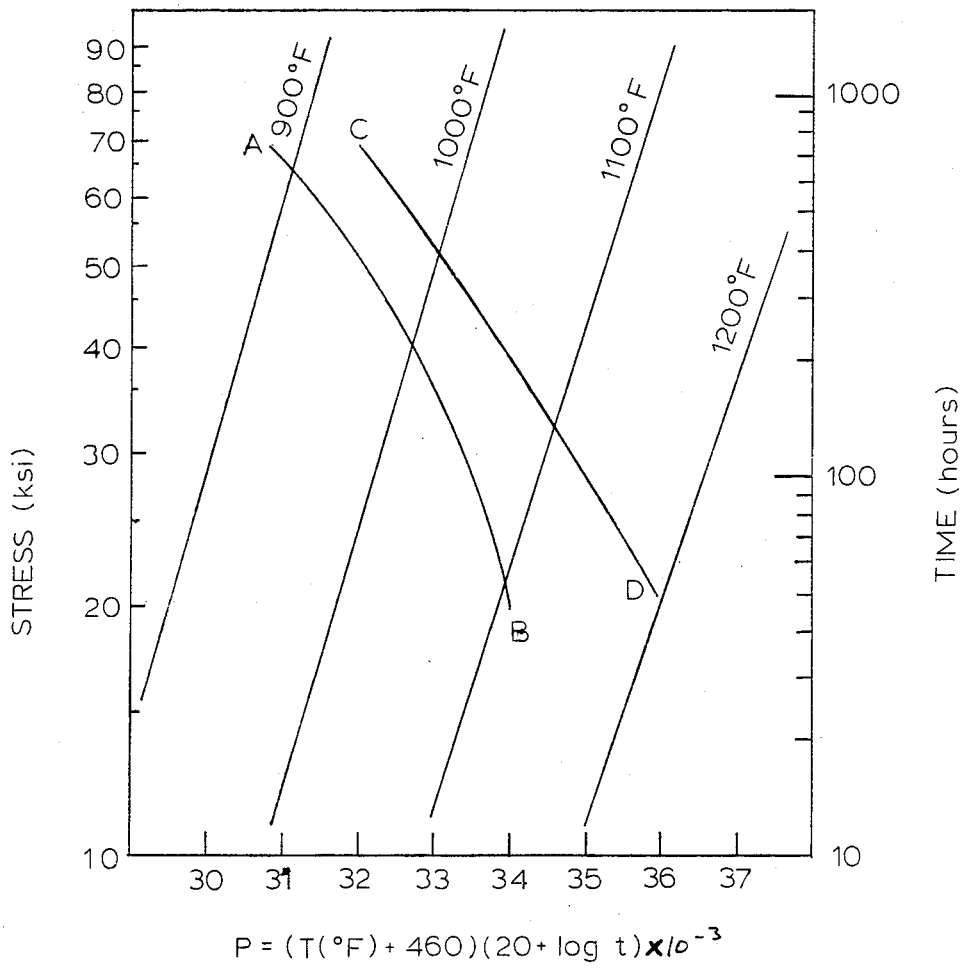
FIG. 1 is a Larson-Miller 0.2% Creep Plot comparing a conventional alloy with an alloy in accordance with the invention.

Broadly, the invention is a titanium-base alloy characterized by good elevated temperature properties, particularly creep resistance in the 950°–1100° F. temperature range. The alloy consists essentially of, in weight percent, aluminum 5.5 to 6.5, tin 2.00 to 4.00, preferably 2.25 to 3.25, zirconium 3.5 to 4.5, molybdenum 0.3 to 0.5, silicon above 0.35 to 0.55, iron less than 0.03, oxygen up to 0.14 and preferably up to 0.09, and balance titanium and incidental impurities and alloying constituents that do not materially affect the properties of the alloy.

The alloy exhibits an average room temperature yield strength of at least 120 ksi. In addition, the alloy's creep properties are characterized by a minimum of 750 hours to 0.2% creep deformation at 950° F. and 60 ksi. Specifically in this regarding, the invention alloy (line C-D) has creep properties approximately 75° F. better than the conventional alloy Ti-6242-Si (line A-B), as evidenced by the Larson-Miller plot constituting FIG. 1. As an example of the improvement the invention alloy provides over conventional Ti-6242-Si, the plot shown in FIG. 1 can be used to estimate time to 0.2% creep strain (a reasonable design limit) under operating conditions of 1000° F. and 25 ksi (reasonable operating parameters for components utilizing such alloys). The plot in FIG. 1 shows that a component made of conventional Ti-6242-Si would be expected to last approximately 1,000 hours under such conditions; whereas, a component made from the invention alloy would last approximately 20,000 hours.

In addition, the invention alloy exhibits a lower limit of 10% room temperature elongation after a 500-hour creep exposure at 950° F. and 60 ksi, as well as a lower limit of 4% room temperature elongation after 500 hours at 1100° F. and 24 ksi.

The alloy of the invention embodies a silicon content higher than conventional for the purpose of creep resistance. Moreover, increased silicon is used in combination with a lower than conventional molybdenum and iron content for improving creep resistance. Oxygen is reduced for post-creep stability. Although the alloy of the invention finds greater application when heat treated or processed to achieve a transformed beta microstructure, it is well known that an alpha-beta microstructure results in somewhat decreased creep properties but exhibits higher strength and improved low cycle fatigue resistance. Consequently, the alloy of the invention finds utility in both the beta and alpha-beta processed microstructures.

DESCRIPTION OF THE PREFERRED EMBODIMENTS AND EXAMPLES

In the experimental work leading to and demonstrating the invention, the conventional Ti-6242-Si alloy was used as a base and modifications were made with respect to aluminum, tin, zirconium, molybdenum, silicon, oxygen and iron. Since the beta processed microstructure is known to provide maximum creep resistance, all of the alloys were evaluated in this condition including the conventional base alloy material.

The material used for testing consisted of 250-gram button heats which were hot rolled to ½-inch diameter bars. The bars were beta annealed, given an 1100° F./8 hr stabilization age and subsequently machined into conventional tensile and creep specimens.

TABLE I

| | Chemistry (wt. %)*** | | | | | | | Aluminum Effect: R.T. Tensile | | 900° F. Tensile | | 950° F./60 ksi Creep | | | 1050° F./40 ksi Creep | | |
|---|---|---|---|---|---|---|---|---|---|---|---|---|---|---|---|---|---|
| | Al | Sn | Zr | Mo | Si | $O_2$ | Fe | YS | % RA | YS | % RA | $\dot{\varepsilon}$ | t(.2) | % RA' | $\dot{\varepsilon}$ | t(.2) | % RA' |
| (1) | 6½ | 2 | 4 | .4 | .45 | .07 | .02 | 129 | 18.2 | 82 | 30 | 1.1 | 1350* | 11.3 | 5.0 | 260 | 7.0 |
| (2) | 6 | 2 | 4 | .4 | .45 | .07 | .02 | 128 | 10.4 | 75 | 29 | .2 | 6500* | 14.8 | 3.5 | 380 | N.D. |
| (3) | 5½ | 2 | 4 | .4 | .45 | .07 | .02 | 125 | 18.4 | 74 | 30 | 0 | ** | 20.4 | 4.0 | 300 | 8.5 |

Notes:
YS = Yield strength in ksi
% RA = Percent reduction in area
% RA' = Room temp. reduction in area after creep exposure of at least 400 hours
$\dot{\varepsilon}$ = Steady state creep rate (in./in./hr × $10^{-4}$)
t(.2) = Time in hrs. to .2% creep deformation
N.D. = Not determined
*extrapolated
**indeterminable
***composition based on formulated melt charge Table I represents three alloy compositions within the scope of the composition limits of the invention. The composition of the three alloys is identical except that the aluminum content ranges from 5.5% to 6.5%. It may be seen from Table I that increasing aluminum from the 6% level slightly degrades post-creep ductility (% RA'). At the lower aluminum level, strength is slightly reduced. Since strength decreases with lower aluminum content but post-creep ductility is decreased with higher aluminum contents, aluminum must be controlled in accordance with the invention.

TABLE II

| | Chemistry (wt. %)*** | | | | | | | Tin & Oxygen Effects: R.T. Tensile | | 950°/60 ksi Creep | | | 1100° F./24 ksi Creep | | |
|---|---|---|---|---|---|---|---|---|---|---|---|---|---|---|---|
| | Al | Sn | Zr | Mo | Si | Fe | $O_2$ | YS | % RA | $\dot{\varepsilon}$ | t(.2) | % RA' | $\dot{\varepsilon}$ | t(.2) | % RA' |
| (1) | 6 | 2 | 4 | .4 | .45 | .02 | .07 | 128 | 10.4 | .2 | 6500* | 14.8 | 2.8 | 550 | 4.0 |
| (2) | " | " | " | " | " | " | .10 | 133 | 8.9 | .4 | 3250* | 15.8 | 2.0 | 750* | 4.0 |
| (3) | " | " | " | " | " | " | .14 | 134 | 14.8 | .4 | 3520* | 8.8 | 3.5 | 450 | 3.9 |
| (4) | " | 3 | " | " | " | " | .07 | 131 | 9.6 | 0 | ** | 13.0 | 3.2 | 550 | 4.4 |
| (5) | " | " | " | " | " | " | .10 | 135 | 6.9 | 1.0 | 1500* | 4.6 | 2.5 | 590 | 3.5 |
| (6) | " | 4 | " | " | " | " | .07 | 132 | 20.5 | 0 | ** | 3.1 | 2.1 | 800* | 5.0 |

Figure 2:
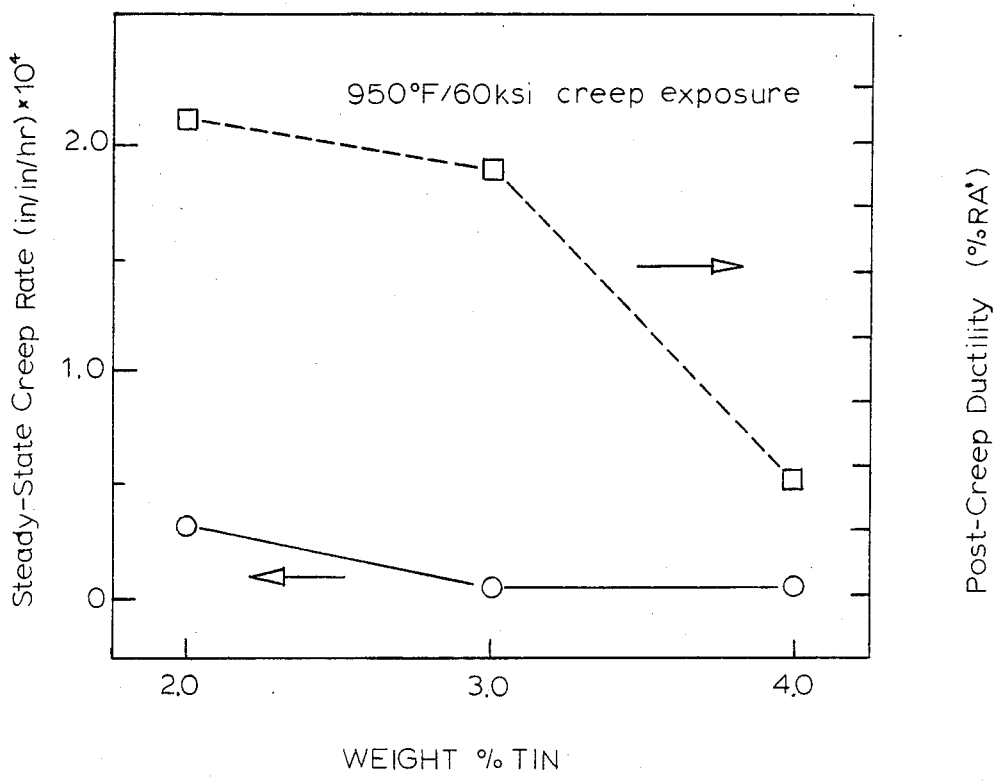
FIG. 2 is a graph showing the effect of tin on steady state creep rate and post creep ductility for a Ti-6Al-xSn-4Zr-0.4Mo-0.45Si-0.070$_2$-0.02Fe base alloy.

Notes:
YS = Yield strength in ksi
% RA = Percent reduction in area
% RA' = Room temp. reduction in area after creep exposure of at least 400 hours
$\dot{\varepsilon}$ = Steady state creep rate (in/in/hr × $10^{-4}$)
t(.2) = Time in hrs. to .2% creep deformation
N.D. = Not determined
*extrapolated
**indeterminable
***composition based on formulated melt charge Table II shows the effect of tin and oxygen on creep resistance and post-creep ductility. As may be seen in Table II by comparing, for example, Alloy 1 with Alloy 6 wherein tin is increased from 2% to 4%, respectively, with oxygen being maintained at 0.07%, a significant degradation in post-creep ductility results although no significant change in creep resistance is noted. A portion of this data is plotted in FIG. 2 with respect to the effect of tin on 950° F./60 ksi creep properties in a Ti-6Al-xSn-4Z4-0.4Mo-0.45Si-0.070²-0.02Fe base alloy. The effect of tin on steady-state creep rate is represented by the solid line, and post creep ductility by the dashed line. The trend indicated in this plot suggests that tin should be kept below approximately the 3.25% level in this base if sufficient post-creep ductility is to be maintained.

Table II also shows that as oxygen is increased in a given base, post-creep ductility is reduced. The drop in post-creep ductility with increased oxygen is more pronounced at the higher tin level.

TABLE III

| | Chemistry (wt. %)*** | | | | | | | Zirconium Effect: R.T. Tensile | | 950° F./60 ksi Creep | | | 1050° F./40 ksi Creep | | | 1100° F./24 ksi Creep | | |
|---|---|---|---|---|---|---|---|---|---|---|---|---|---|---|---|---|---|---|
| | Al | Sn | Zr | Mo | Si | $O_2$ | Fe | YS | % RA | $\dot{\varepsilon}$ | t(.2) | % RA' | $\dot{\varepsilon}$ | t(.2) | % RA' | $\dot{\varepsilon}$ | t(.2) | % RA' |
| (1) | 6 | 2 | 2½ | .4 | .45 | .10 | .02 | 132 | 20.3 | 1.3 | 1300* | 9.8 | 8.4 | 140 | 4.2 | 4.5 | 225 | 6.9 |
| (2) | " | " | 4 | " | " | " | " | 136 | 14.5 | 1.1 | 2600* | 11.3 | 3.7 | 300 | 6.0 | 2.2 | 660* | 3.8 |

Notes:
YS = Yield strength in ksi
% RA = Percent reduction in area
% RA' = Room temp. reduction in area after creep exposure of at least 400 hours
$\dot{\varepsilon}$ = Steady state creep rate (in/in/hr × $10^{-4}$)
t(.2) = Time in hrs. to .2% creep deformation
N.D. = Not determined
*extrapolated
**indeterminable
***composition based on formulated melt charge Table III shows the effect of zirconium on post-creep ductility and creep resistance. Specifically, as may be seen from Table III, zirconium within the range of 2.5 to 4% has no significant effect on post-creep ductility but has a significant effect on the creep resistance, particularly as demonstrated by the time to 0.2% elongation data. Thus, zirconium should be maintained at the 4% level.

TABLE IV

| | Chemistry (wt. %)*** | | | | | | | Additional Molybdenum Study | | | | | | | | |
|---|---|---|---|---|---|---|---|---|---|---|---|---|---|---|---|---|
| | | | | | | | | 950° F./60 ksi Creep | | | 1050° F./40 ksi Creep | | | 1100° F./24 ksi Creep | | |
| | Al | Sn | Zr | Mo | Si | $O_2$ | Fe | $\dot{\epsilon}$ | t(.2) | % RA' | $\dot{\epsilon}$ | t(.2) | % RA' | $\dot{\epsilon}$ | t(.2) | % RA' |
| (1) | 6 | 2 | 4 | .5 | .45 | .10 | .02 | 2.6 | 540* | 5.0 | 6.8 | 175 | 5.0 | 1.9 | 530 | 7.2 |
| (2) | " | " | " | .4 | " | " | .02 | 1.1 | 2610* | 11.3 | 3.7 | 290 | 6.0 | 2.2 | 660* | 3.8 |
| (3) | " | " | " | .3 | " | " | .02 | 1.8 | 780* | 3.9 | 3.6 | 500 | 5.0 | 2.2 | 700* | 3.0 |

Figure 3:
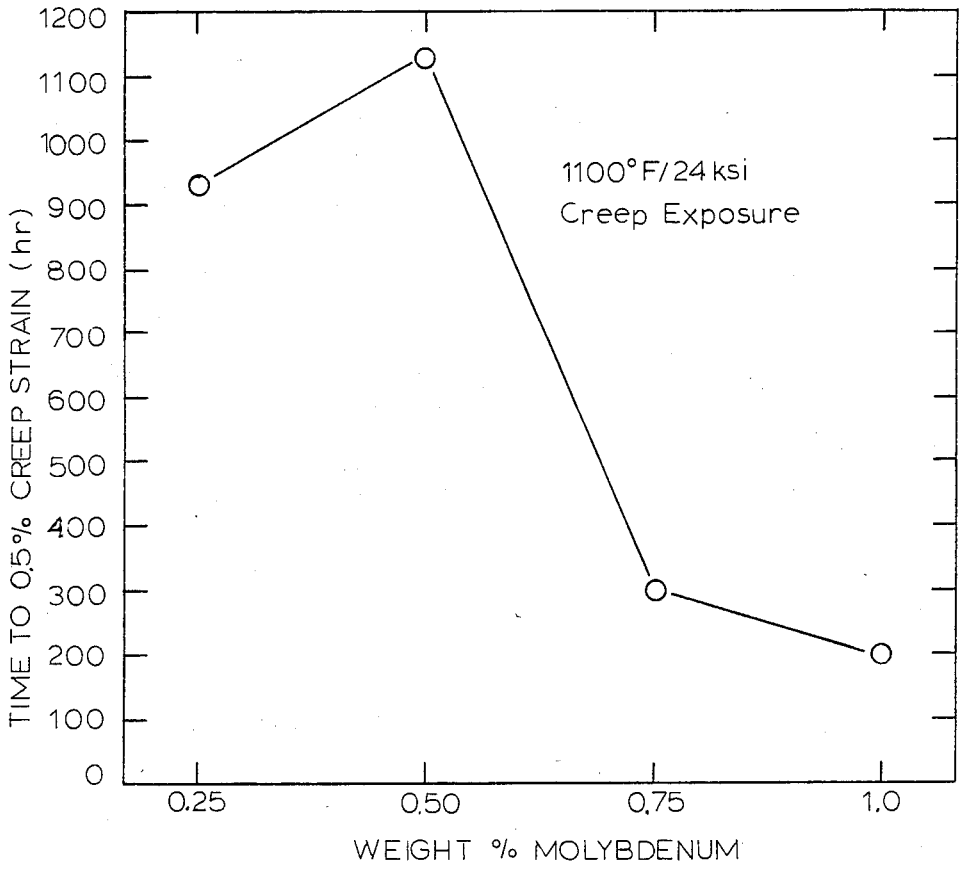
FIG. 3 is a graph showing time to 0.5% creep strain vs. molybdenum content for an alloy containing Ti-6Al-4Sn-4Zr-xMo-0.2Si-0.100$_2$-0.05Fe plus other minor additions.

Notes:
YS = Yield strength in ksi
% RA = Percent reduction in area
% RA' = Room temp. reduction in area after creep exposure of at least 400 hours
$\dot{\epsilon}$ = Steady state creep rate (in/in/hr × $10^{-4}$)
t(.2) = Time in hrs. to .2% creep deformation
N.D. = Not determined
*extrapolated
**indeterminable
***composition based on formulated melt charge FIG. 3 shows the effect of molybdenum on time to 0.5% elongation at 1100° F. at 24 ksi. The plot of FIG. 3 shows in this regard that molybdenum should be below about 0.5% in order to maximize the time to 0.5% creep strain. Further with respect to molybdenum, Table IV shows that a molybdenum content of 0.4% provides an optimum combination of creep resistance and post-creep ductility. These results show that the molybdenum content is important and should be strictly controlled within narrow limits. The range of 0.3 to 0.5 is a practical range from a production standpoint.

Figure 4:
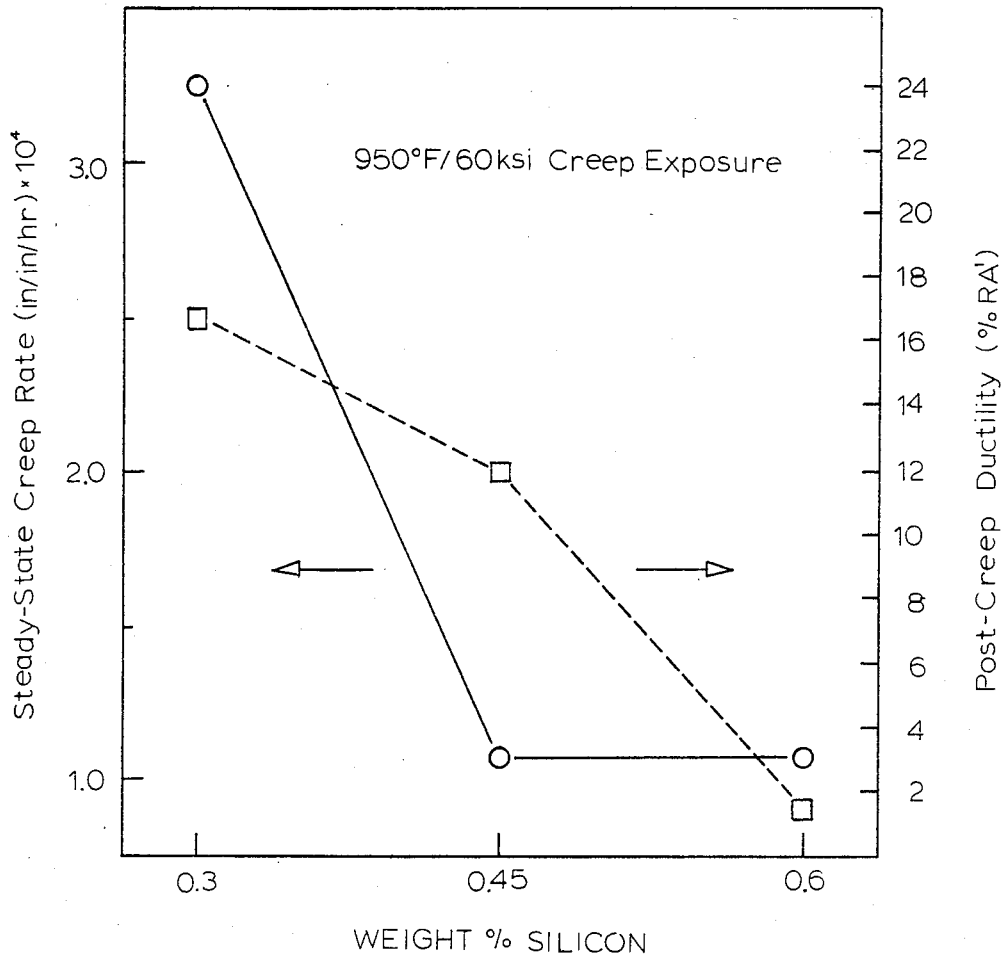
FIG. 4 is a graph showing the effect of silicon on steady state creep resistance and post-creep ductility in a Ti-6Al-2Sn-4Zr-0.4Mo-xSi-0.100$_2$-0.02Fe alloy.

Table V and FIG. 4 show the effect of silicon with respect to both creep resistance and post-creep ductility. The solid line represents steady-state creep resistance and the dashed line post-creep ductility. Moreover specifically, the data show that increasing silicon increases creep resistance up to about 0.45% silicon. At a silicon content of 0.6%, however, severe degradation of post-creep ductility results with no apparent gain in creep resistance. Consequently, silicon should be at an upper limit of approximately 0.55% in order to retain post-creep ductility but should not fall significantly below 0.45% in order to retain creep resistance. Thus, a range of above 0.35 to 0.55 is established in order to be within production melting tolerances.

TABLE VI

| | Chemistry (wt. %)*** | | | | | | | Iron Study | | | | | | | | | | |
|---|---|---|---|---|---|---|---|---|---|---|---|---|---|---|---|---|---|---|
| | | | | | | | | R.T. Tensile | | 950° F./60 ksi Creep | | | 1050° F./40 ksi Creep | | | 1100° F./24 ksi Creep | | |
| | Al | Sn | Zr | Mo | Si | $O_2$ | Fe | YS | RA | $\dot{\epsilon}$ | t(.2) | RA' | $\dot{\epsilon}$ | t(.2) | RA' | $\dot{\epsilon}$ | t(.2) | RA' |
| (1) | 6 | 2.5 | 4 | .4 | .45 | .07 | .01 | 133 | 16.4 | .6 | 2750* | 16.3 | 5.6 | 300 | 7.5 | 2.4 | 620* | 4.2 |
| (2) | " | " | " | " | " | " | .02 | 135 | 10.3 | 1.5 | 1020* | 14.5 | 6.6 | 200 | 6.5 | 2.4 | 350 | 5.5 |
| (3) | " | " | " | " | " | " | .04 | 132 | 17.3 | 3.3 | 250 | 12.7 | 8.0 | 90 | 7.9 | 2.1 | 500 | 2.3 |

Figure 5:
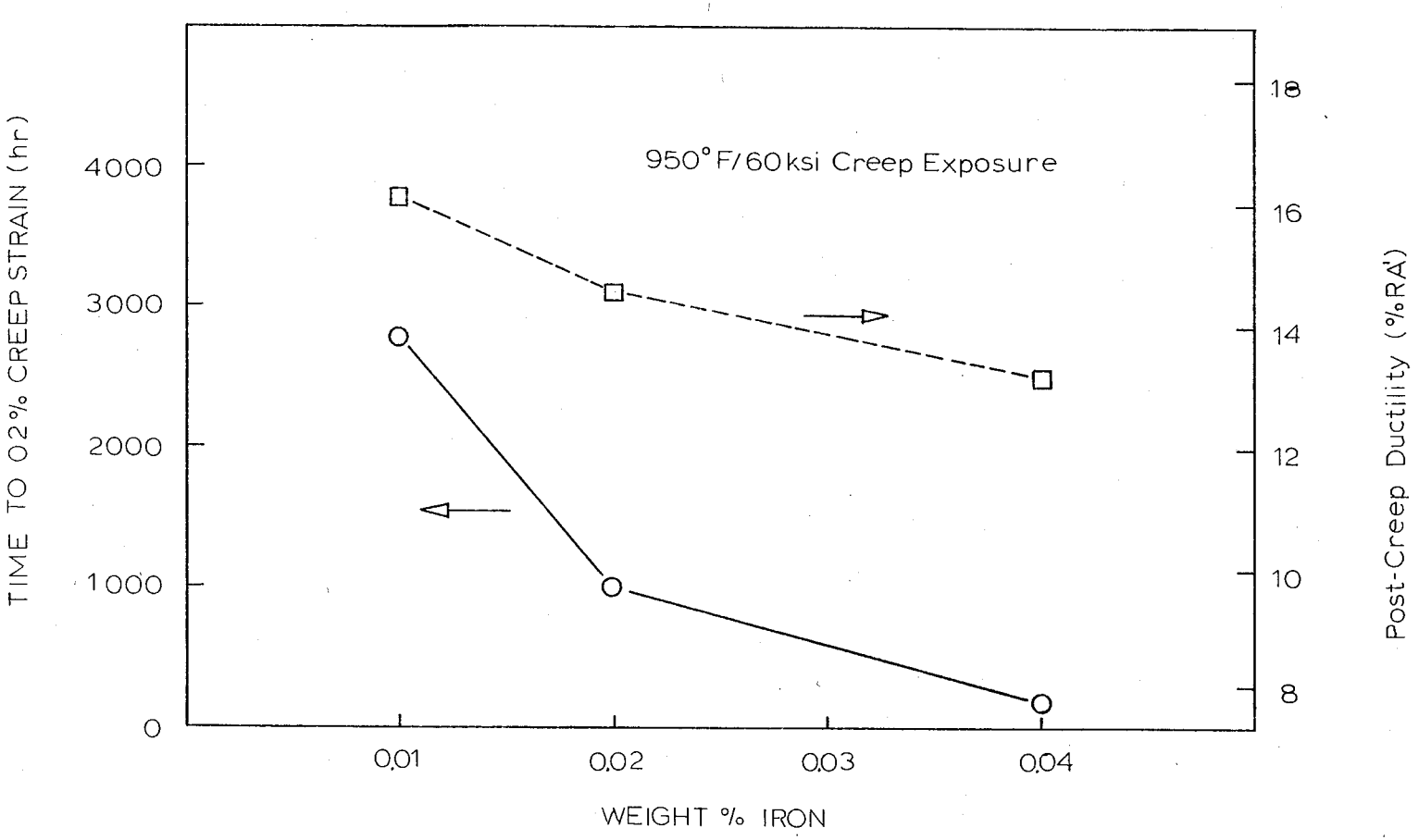
FIG. 5 is a graph showing the effect of iron on time to 0.2% creep strain and post-creep ductility for a Ti-6Al-2.5Sn-4Zr-0.4Mo-0.45Si-0.070$_2$-xFe alloy.

Notes:
YS = Yield strength in ksi
% RA = Percent reduction in area
% RA' = Room temp. reduction in area after creep exposure of at least 400 hours
$\dot{\epsilon}$ = Steady state creep rate (in/in/hr × $10^{-4}$)
t(.2) = Time in hrs. to .2% creep deformation
N.D. = Not determined
*extrapolated
**indeterminable
***composition based on formulated melt charge The data in Table VI and FIG. 5 demonstrates the significant effect of iron with respect to creep resistance. Time to 0.2% creep strain is represented by the solid line and post-creep ductility by the dashed line. Specifically, the data show that by restricting the iron content, and specifically by restricting iron to less than

TABLE V

| | Chemistry (wt. %)*** | | | | | | | Silicon Study | | | | | | | | | | |
|---|---|---|---|---|---|---|---|---|---|---|---|---|---|---|---|---|---|---|
| | | | | | | | | R.T. Tensile | | 950° F./60 ksi Creep | | | 1050° F./40 ksi Creep | | | 1100° F./24 ksi Creep | | |
| | Al | Sn | Zr | Mo | Si | $O_2$ | Fe | YS | % RA | $\dot{\epsilon}$ | t(.2) | % RA' | $\dot{\epsilon}$ | t(.2) | % RA' | $\dot{\epsilon}$ | t(.2) | % RA' |
| (1) | 6 | 2 | 4 | .4 | .3 | .10 | .02 | 131 | 19.1 | 3.2 | 340* | 15.7 | 24.4 | 75 | 8.8 | 1.8 | 550 | 6.0 |
| (2) | " | " | " | " | .45 | " | " | 136 | 14.5 | 1.1 | 2600* | 11.3 | 3.7 | 300 | 6.0 | 2.2 | 660 | 3.8 |
| (3) | " | " | " | " | .6 | " | " | 136 | 7.4 | 1.1 | 1100* | 1.6 | 3.0 | 450 | 4.1 | 1.1 | 1180* | 4.0 |

Notes:
YS = Yield strength in ksi
% RA = Percent reduction in area
% RA' = Room temp. reduction in area after creep exposure of at least 400 hours
$\dot{\epsilon}$ = Steady state creep rate (in/in/hr × $10^{-4}$)
t(.2) = Time in hrs. to .2% creep deformation
N.D. = Not determined
*extrapolated
**indeterminable
***composition based on formulated melt charge 0.03%, creep resistance is improved with no adverse effect on the post-creep ductility of the alloys tested.

As may be seen from the data as presented and discussed above, the invention provides an improved high-temperature titanium-based alloy which can be used at temperatures approximately 75° F. higher than commercial alloys, such as Ti-6242-Si, and will exhibit at these increased temperatures an excellent combination of strength, creep resistance and post-cree stability.

These properties are achieved by a critical control of alloy chemistry. In particular, iron must be kept considerably lower than normal and molybdenum, silicon and oxygen must be controlled to within narrow ranges, these ranges being outside the typical ranges for conventional alloys.

What is claimed is:

1. A titanium-base alloy characterized by good elevated temperature properties, particularly creep resistance in the 950° to 1100° F. temperature range, said alloy consisting essentially of, in weight percent, aluminum 5.5 to 6.5, tin 2.00 to 4.00, zirconium 3.5 to 4.5, molybdenum 0.3 to 0.5, silicon above 0.35 to 0.55, iron less than 0.03, oxygen up to 0.14 and balance titanium and incidental impurities.

2. The alloy of claim 1 wherein tin is within the range of 2.25 to 3.25.

3. The alloy of claim 1 or claim 2 wherein oxygen is up to 0.09.

4. A titanium-base alloy characterized by good elevated temperature properties, particularly creep resistance in the 950° to 1100° F. temperature range, said alloy consisting essentially of, in weight percent, aluminum 5.5 to 6.5, tin 2.00 to 4.00, zirconium 3.5 to 4.5, molybdenum 0.3 to 0.5, silicon above 0.35 to 0.55, iron less than 0.03, oxygen up to 0.14 and balance titanium and incidental impurities, said alloy exhibiting an average room temperature yield strength of at least 120 ksi, a minimum of 750 hours to 0.2% creep at 950° F. at 60 ksi and a lower limit of 10% room temperature elongation after 500 hours at 950° F. and 60 ksi and 4% room temperature elongation after 500 hours at 1100° F. and 24 ksi.

5. The alloy of claim 4 wherein tin is within the range of 2.25 to 3.25.

6. The alloy of claim 4 or claim 5 wherein oxygen is up to 0.09.

7. The alloy of claim 1 or claim 2, wherein iron is less than 0.02%.

* * * * *